United States Patent [19]

Takeda et al.

[11] 4,076,530

[45] Feb. 28, 1978

[54] DRY PHOTOGRAPHIC COPYING METHOD FOR PRODUCING TE IMAGES

[75] Inventors: Keiji Takeda; Kenji Matsumoto; Hiroshi Tamura; Masayoshi Nagata; Masayoshi Tsuboi, all of Asaka, Japan

[73] Assignee: Fuji Photo Film Co., Ltd., Minami-ashigara, Japan

[21] Appl. No.: 683,606

[22] Filed: May 5, 1976

[30] Foreign Application Priority Data

May 7, 1975 Japan ..... 50-55074

[51] Int. Cl.[2] ..... G03C 5/54; G03C 5/24; G03C 1/48

[52] U.S. Cl. ..... 96/29 R; 96/48 HD; 96/76 R

[58] Field of Search ..... 96/29 R, 29 D, 48 HD, 96/76 R

[56] References Cited

U.S. PATENT DOCUMENTS 3,733,201 5/1973 Barr ..... 96/29 D 3,816,131 6/1974 Kampfer et al. ..... 96/29 D 3,819,377 6/1974 Klose et al. ..... 96/48 HD

*Primary Examiner*—David Klein

*Assistant Examiner*—Richard L. Schilling

*Attorney, Agent, or Firm*—Sughrue, Rothwell, Mion, Zinn and Macpeak

[57] ABSTRACT

A method for producing an image comprising imagewise exposing a light-sensitive layer containing a sensitizing agent and an image forming compound which can be transferred at non-exposed areas to an image receiving layer upon heating at about 80° to about 200° C, and which can be changed to a non-transferable compound at exposed areas, contacting the light-sensitive layer with the image receiving layer containing a compound which forms a colored image upon reaction with the image forming compound, and heating the light-sensitive layer to transfer the image forming compound to the image receiving layer at non-exposed areas, wherein the image receiving layer comprises an organic tellurium compound and a binder formed on a support.

16 Claims, No Drawings

DRY PHOTOGRAPHIC COPYING METHOD FOR PRODUCING TE IMAGES

BACKGROUND OF THE INVENTION

1. Field of the Invention

The present invention relates to a dry photographic copying method. More particularly, it relates to a dry photographic copying method wherein an image forming layer is image-wise exposed and contacted with an image receiving layer and then heated.

2. Description of the Prior Art

Methods for producing a copy by a dry photographic process are known. Among those is known a dry photographic process in which a colored image is formed on an image receiving sheet by image-wise exposing a light-sensitive layer containing a light-sensitive image forming compound which is changed to a non-transferable compound upon exposure and then contacting the light-sensitive layer with an image receiving layer and heating the light-sensitive layer to transfer the image forming compound to the image receiving layer. Necessary requirements for the above-described process are as follows. The image forming compound must lose transferability upon exposure, and an image forming component which can form a colored image upon reaction with the image forming compound must be contained in the image receiving layer; further, the image forming compound must be transferable upon heating, and the image forming compound and the image forming component must react when heated to form color.

One example of the above described process includes a light-sensitive layer containing a transferable compound and a sensitizing dye as described in U.S. Pat. Nos. 2,789,904 and 3,094,417. The transferable compound (e.g., 4-methoxy-1-naphthol) is converted to a non-transferable compound upon exposure. This compound is transferred from non-exposed areas of the light-sensitive layer to the image receiving layer by heating and reacts with a silver compound (silver behenate) to form a positive image.

A light sensitive layer containing an organic tellurium compound is described in Japanese Patent Publication (OPI) No. 29438/73. This compound is a compound in which a tellurium atom and an organic group are bonded directly [e.g., $(C_6H_5COCH_2)_2$-$TeCl_2$], and a black image comprising free tellurium crystals is obtained when heating after image-wise exposing the above described organic tellurium compound containing light-sensitive layer in the presence of a proper optical sensitizing agent (e.g., benzophenone). Further, a complex formed from a tellurium halide and an organic base [e.g., $(C_{14}H_{29}NH_2)n : TeCl_4$, $(CH_3COCoH_4—NH_2)_2 : TeCl_4$, etc.] can also be used as a light-sensitive material like the above described compound, as is disclosed in Japanese Patent Publication (OPI) No. 14330/74.

SUMMARY OF THE INVENTION

The present invention is based on the fact that an organic tellurium compound which is not a silver compound is easily reducible as the image forming component and can provide a black image when reduced and that fact is usable in these processes.

The present inventors have performed intensive research, and have found that these organic tellurium compounds can produce tellurium atoms and become black upon mere heating in the presence of a reducing substance, and, further, can be used as an image forming component in the above described heat transferable light-sensitive material, thus reaching the present invention.

The organic tellurium compound has the advantage that a compound having the most desirable ability to be reduced when heated can be selected since the bonding between a tellurium atom and an organic moiety can be widely changed. The organic tellurium compound also has the advantages that the color of the organic tellurium compound is generally white and the image formed by reduction is dark blue to black, and has a higher covering power (image density obtained with 1 g/100cm$^2$) than a silver image formed with a silver salt such as silver behenate, and, further, the color of the image is not changed by water, heat, sulfurdioxide gas or hydrogen sulfide gas. Further, the organic tellurium compound itself is not colored when heated to a temperature as is generally used for copying processes, and this means that the organic tellurium compound does not readily produce fog. Another advantage of using the organic tellurium compound as the image forming component is that a recording material of lower price than known recording materials which comprise a silver compound can be obtained.

DETAILED DESCRIPTION OF THE INVENTION

A typical constitution of the present invention is described in the following. The light-sensitive layer formed on a support comprises a binder, a light-sensitive image forming compound, and, if desired, a dye, a sensitizing agent, a plasticizer, etc.

On the other hand, the image receiving layer formed on a support comprises a binder, an organic tellurium compound, and, if desired, an auxiliary reducing agent, an anti-fogging agent (or a whitening agent), a plasticizer, stabilizing agent, etc.

It is preferred in accordance with the present invention that the amount of binder be from about 0.5 to about 100 g/m$^2$ of the support, even more preferably 1 to 30 g/m$^2$, and the organic tellurium compound be utilized in an amount of from about 0.01 to about 10 g/m$^2$ of the support, even more preferably 0.05 to 5 g/m$^2$. The amounts of other ingredients preferably utilized can be calculated from the relationships set forth in this specification and thicknesses as are described in this specification.

The transferable image forming compound contained in the light-sensitive layer includes $\alpha$-naphthol derivatives as described in U.S. Pat. Nos. 2,789,904, 3,076,707 and 3,094,417. The light-sensitive materials described in these patents may be utilized in the copying method of the present invention. Specific examples include 4-methoxy-1-naphthol, 1-hydroxy-2-methyl-4-methoxynaphthalene, 1-hydroxy-4-ethoxynaphthalene, 4,4'-dimethoxy-1,1'-dihydroxy-2,2'-binaphthyl, 1,4-dihydroxy-2,2'-binaphthyl, 1,4-dihydroxynaphthalene, 1,3-dihydroxynaphthalene. In general, useful $\alpha$-naphthol light-sensitive image forming compounds are $\alpha$-naphthols in which an electron donating substituent such as an alkyl, aryl, alkoxy, aryloxy, hydroxy or amino group is introduced into a hydroxy-substituted aromatic ring. On the other hand, a condensation product of 1,5-dihydroxynaphthalene and acetone or adipoylchloride can be exmployed as light-sensitive image forming precursor.

Other useful light-sensitive image forming precursors are hydrozones whose amino group is not substituted or substituted by an electron donating group such as an aryl or alkyl group, such as phenylhydrazone, N,N-dimethylhydrazone, etc. Further, substituted oxazoles and substituted imidazoles such as 2,5-diphenyloxazole, 2-(1-naphthyl)-5-phenyloxazole, triphenylimidazole, etc., can be used.

The following sensitizing agents can optionally be present with these light-sensitive image forming compounds in the light-sensitive sheet. One type of sensitizing agent includes an oxygen sensitizing dye which is a polycyclic aromatic sensitizing dye as is described in Japanese Patent Publication (OPI) No. 38136/73. Examples of the dyes are shown in the following, which can be present with the α-naphthols.

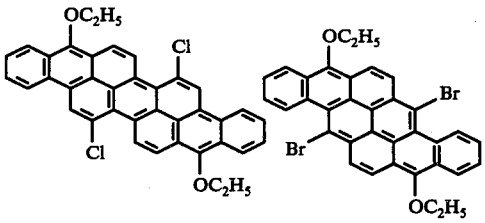

Another type of sensitizing agent includes derivatives of bisimidazolyl compounds as described in Japanese Patent Publication (OPI) No. 4733/71. Examples of these derivatives are bis[2-(o-chlorophenyl)-4,5-diphenylimidazole], bis[2-phenyl-4,5-di-(p-methoxyphenyl)-imidazole], etc., and these compounds can also be present with the α-naphthols in the light-sensitive layer. Further, pyrazolone-5-one compounds as described in British Pat. Nos. 1,341,092 and 1,342,971 can be present. An example of these compounds is N-phenyl-3-methyl-pyrazoline-5-one, etc.

The light-sensitive layer for the present invention comprises a binder and an image forming compound, and, if desired, a sensitizing compound. These compounds are preferably dissolved in a common solvent and coated on a support.

These and other detailed descriptions on the constitution of the light-sensitive material (e.g., an image forming compound, a sensitizing agent, a binder, a support, etc.) used for the method of the present invention and method for manufacture are given in U.S. Pat. Nos. 2,789,904, 3,076,707 and 3,094,417; Japanese Patent Publications (OPI) Nos. 38136/73, 4733/71 and 5478/72'; U.S. Pat. No. 3,816,131; Japanese Patent Publication (OPI) No. 5737/72; British Pat. Nos. 1,341,092, 1,342,971 and 1,353,810; U.S. Pat. Nos. 3,799,779 and 3,810,760; etc., and one skilled in the art can produce the light-sensitive material by referring to these descriptions. In the following, the constitution and methods for manufacturing the image receiving layer, which is the most characteristic feature of the present invention, are described in detail.

The organic tellurium compound used as the image forming component in the image receiving layer used in the method of the present invention is selected from the compounds listed in the following first group to third group. Two or more compounds can be used at the same time, if desired, though only one compound is necessary.

First Group

Compounds represented by general formula (1).

$$Y - TeX_2 - Y' \quad (1)$$

wherein X represents a chlorine, bromine or iodine atom and the two halogen atoms can be the same or different from each other, Y and Y' represent groups selected from the following group (A) to group (C) and Y and Y' can be the same or different from each other.

(A) Y, Y' belonging to an Ar — CO — $CH_2$ - group:

Ar designates a phenyl group, naphthyl group, anthryl group, furyl group, thienyl group, xanthenyl group, benzofuranyl group, benzoquinonyl group or a substituted group thereof. The substituents include an alkyl group (1 to 20 carbon atoms; straight, branched or cyclic); a substituted alkyl group [1 to 20 carbon atoms; straight, branched or cyclic; the substituents include a hydroxyl group, an alkoxy group (preferably containing 1 to 5 carbon atoms), a halogen atom, a cyano group, an acetyl group, a phenyl group, a naphthyl group, a phenoxy group, a phenyl group substituted by a halogen atom, a naphthyl group substituted by a halogen atom, a phenoxy group substituted by a halogen atom, etc.], a halogen atom, a hydroxyl group, an alkoxy group (1 to 20 carbon atoms; straight, branched or cyclic), an alkoxy group substituted by a halogen atom (1 to 20 carbon atoms; straight, branched or cyclic), an acyl group such as an acetyl group (1 to 20 carbon atoms, straight, branched or cyclic), a benzoyl group, a substituted benzoyl group (substituents include an alkyl group containing 1 to 5 carbon atoms, a haloalkyl group which is a halogen (such as F, Cl, Br, I) substituted alkyl group having 1 to 5 carbon atoms, a halogen atom, etc.), a nitro group, a cyano group, a phenyl group, a phenoxy group, a substituted phenyl or phenoxy group [such substituents include an alkyl group having 1 to 10 carbon atoms, a haloalkyl group which is a halogen (such as F, Cl, Br, I) substituted alkyl group having 1 to 5 carbon atoms, and an alkoxy group having 1 to 10 carbon atoms, etc.], an alkenyl group (containing 1 to 20 carbon atoms, e.g., a vinyl group, allyl group, methylvinyl group, butenyl group, etc.) and a substituted alkenyl group [which is alkenyl group as described above substituted by a halogen atom, a hydroxy group, an alkoxy group containing 1 to 5 carbon atoms, a cyano group, an acetyl group, a phenyl group, a substituted phenyl group (substituents include an alkyl group having 1 to 5 carbon atoms, a hydroxy group, an alkoxy group having 1 to 5 carbon atoms, halogen atoms, etc.), etc.], a furyl group, a xanthenyl group, etc.

Specific examples of organic tellurium compounds having these groups are shown in the following using chemical formulae or constitutional formulae:

$(C_6H_5COCH_2)_2TeCl_2$, $(C_{10}H_7COCH_2)_2TeCl_2$, $(C_{14}H_9COCH_2)_2TeCl_2$,

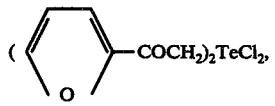

-continued

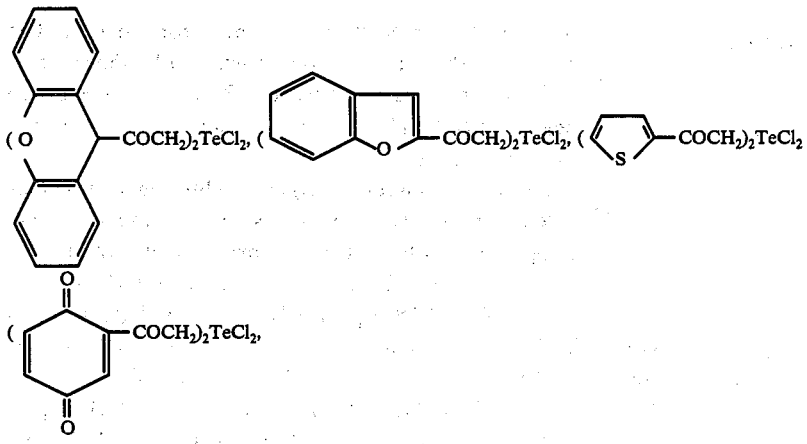

$(CH_3—C_6H_4COCH_2)_2TeCl_2$, $(C_2H_5C_6H_4COCH_2)_2$—$TeCl_2$, $(t—C_4H_9—C_6H_4COCH_2)_2TeCl_2$, $(n—C_{18}H_{37}C_6H_4COCH_2)_2TeCl_2$, $(ClCH_2—C_6H_4COCH_2)_2TeCl_2$, $(C_6H_5CH_2—C_6H_4—COCH_2)_2TeCl_2$, $(C_6H_5OCH_2CH_2—C_6H_4COCH_2)_2TeCl_2$, $(ClC_6H_4COCH_2)_2TeCl_2$, $(BrC_6H_4COCH_2)_2TeCl_2$, $(HO—C_6H_4COCH_2)_2TeCl_2$, $(CH_3O—C_6H_4COCH_2)_2$—$TeCl_2$, $(ClCH_2CH_2O—C_6H_4COCH_2)_2TeCl_2$, $(CH_3COC_6H_4COCH_2)_2TeCl_2$, $(C_6H_5COC_6H_4COCH_2)_2TeCl_2$, $(O_2N—C_6H_4COCH_2)_2TeCl_2$, $(NC—C_6H_4COCH_2)_2$—$TeCl_2$, $(C_6H_5—C_6H_4COCH_2)_2TeCl_2$, $(C_6H_5O—C_6H_4COCH_2)_2TeCl_2$, $(CH_2=CH—C_6H_4COCH_2)_2TeCl_2$, $(C_6H_5CH=CH—C_6H_4COCH_2)_2TeCl_2$, $(CH_2=CH—CH_2—C_6H_4COCH_2)_2TeCl_2$, $(CH_3CH=CH—C_6H_4COCH_2)_2TeCl_2$, $(t—C_4H_9—C_{10}H_6COCH_2)_2TeCl_2$,

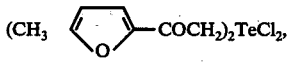

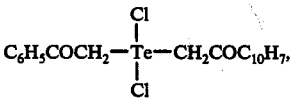

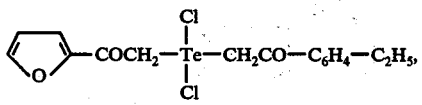

and compounds obtained by substituting one or more chlorine atoms bonded to the tellurium atom of the above described compounds by a bromine or iodine atom, etc.

(B) Y, Y' belonging to an R—$COCH_2$-group:

R designates an alkyl group (1 to 20 carbon atoms; straight, branched or cyclic); an alkenyl group (1 to 20 carbon atoms; straight, branched or cyclic) and a substituted group thereof. Substituent include a halogen atom; a hydroxyl group; an alkoxy group (1 to 10 carbon atoms; straight, branched or cyclic); an alkoxy group substituted with a halogen atom (1 to 10 carbon atoms; straight, branched or cyclic); an acyl group, preferably having 1 to 15 carbon atoms, such as an acetyl group; a cyano group; an aromatic ring containing group such as a phenyl group, napthyl group, anthryl group, phenoxy group and benzoyl group, etc.; a substituted group of these aromatic rings (substituents include an alkyl group containing 1 to 10 carbon atoms and such an alkyl group substituted with an halogen atom or with an alkoxy group, preferably having 1 to 5 carbon atoms; a halogen atom; hydroxyl group; an alkoxy group containing 1 to 10 carbon atoms; an alkoxy group, preferably having 1 to 10 carbon atoms, substituted with a halogen atom; an acyl group, preferably having 1 to 5 carbon atoms such as an acetyl group; a benzoyl group; a phenyl group; a phenoxy group and a substituted benzoyl, phenyl or phenoxy group wherein substituents include an alkyl group having 1 to 10 carbon atoms, a haloalkyl group having 1 to 10 carbon atoms, a halogen atom, etc.), etc.

Further, an organic tellurium compound in which the R part of two R—$COCH_2$-groups are connected to the tellurium such as

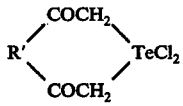

can be used in the present invention. Here, R' designates an alkyl group having 1 to 3 carbon atoms, an alkenyl group having 2 to 4 carbon atoms, and alkyl group ($C_1$ - $C_{10}$) which is substituted with a phenyl group, a halogen atom, etc.

Specific examples of tellurium compounds having these groups (R or R') are shown in the following using chemical formuale or constitutional formulae:

$(CH_3COCH_2)_2TeCl_2$, $(C_2H_5COCH_2)_2TeCl_2$, $(t—C_4H_9COCH_2)_2TeCl_2$, $(n—C_{11}H_{23}COCH_2)_2TeCl_2$, $(CH_2=CH—CH_2COCH_2)_2TeCl_2$, $(CH_3CH=CHCH_2COCH_2)_2TeCl_2$, $(C_6H_{11}COCH_2)_2TeCl_2$, $(ClCH_2COCH_2)_2TeCl_2$, $[Br(CH_2)_4COCH_2]_2TeCl_2$, $(HOCH_2CH_2COCH_2)_2TeCl_2$, $(CH_3OCH_2—CH_2COCH_2)_2TeCl_2$, $(CH_3COCH_2COCH_2)_2TeCl_2$, $(CF_3COCH_2COCH_2)_2$—$TeCl_2$, $(C_6H_5COCH_2COCH_2)_2TeCl_2$, $(C_6H_5CH_2COCH_2)_2TeCl_2$, $(CH_3C_6H_4CH_2COCH_2)_2TeCl_2$, $(ClC_6H_5CH_2CH_2COCH_2)_2TeCL_2$, $(ClCH=CH—COCH_2)_2TeCl_2$, $(C_6H_5—CH=CHCH_2COCH_2)_2TeCl_2$,

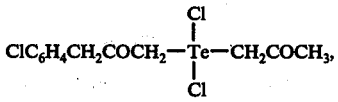

-continued

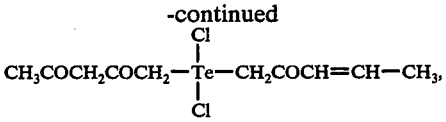

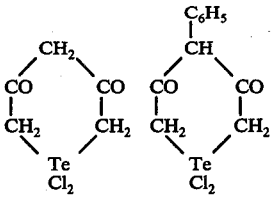

and compounds obtained by substituting one or more of the chlorine atoms bonded to the tellurium atom of the above described compounds by a bromine or iodine atom, etc.

(C) Y, Y' belonging to Ar in (A) or R in (B):

Specific examples of the organic tellurium compounds having these groups are shown in the following using chemical formulae or constitutional formulae:

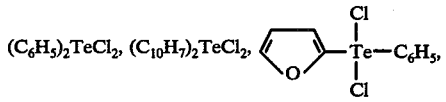

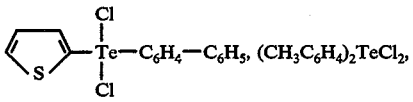

$(NC—C_6H_4)_2TeCl_2$, $(n\text{-}C_5H_{11})_2—TeCl_2$, $(n\text{-}C_{18}H_{37})_2TeCl_2$,

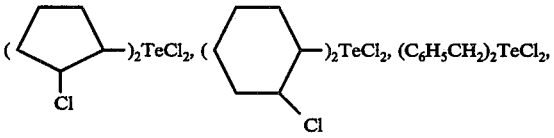

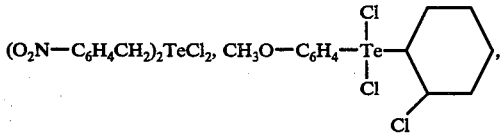

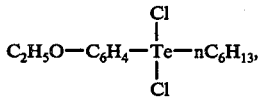

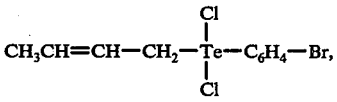

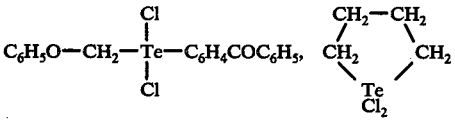

and compounds obtained by substituting one or more chlorine atoms bonded to the tellurium atom of the above described compounds by a bromine or iodine atom, etc.

Second Group

Compounds represented by general formula (2).

$$Z—TeX_3 \qquad (2)$$

wherein X designates a chlorine, bromine or iodine atom, and the three halogen atoms can be the same or different from each other, and Z designates a group belonging to Y, Y' of general formula (1) as described in the First Group.

Specific examples of organic tellurium compounds belonging to this group are shown in the following using chemical formulae or constitutional formulae:

$C_6H_5COCH_2—TeCl_3$, $CH_3C_6H_4COCH_2—TeCl_3$, $CH_3O—C_6H_4COCH_2—TeCl_3$, $Cl—C_6H_4COCH_2—TeCl_3$, $HO—C_6H_4COCH_2—TeCl_3$, $O_2N—C_6H_4COCH_2—TeCl_3$, $NC—C_6H_4COCH_2—TeCl_3$, $CH_2=CH—C_6H_4—COCH_2—TeCl_3$, $CH_3CO—C_6H_4—COCH_2—TeCl_3$, $C_{10}H_7COCH_2—TeCl_3$, $C_{14}H_9COCH_2—TeCl_3$,

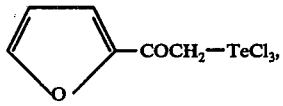

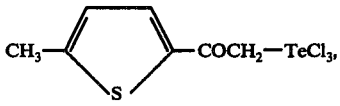

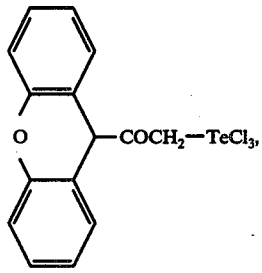

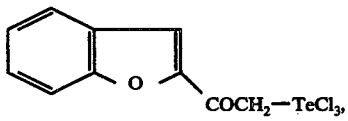

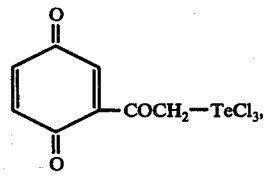

$n—C_6H_{13}—COCH_2—TeCl_3$, $n—C_{18}H_{37}—COCH_2—TeCl_3$, $CH_3COCH_2—TeCl_3$, $t—C_4H_9COCH_2—TeCl_3$, $C_6H_5—CH=CH—CH_2COCH_2—TeCl_3$, $C_6H_5TeCl_3$,

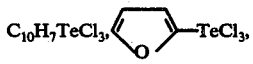

$NC—C_6H_4TeCl_3$, $n—C_4H_9—C_6H_4—TeCl_3$, $C_2H_5O—C_6H_4—TeCl_3$, $C_6H_5COC_6H_4—TeCl_3$, $n—C_6H_{13}—TeCl_3$,

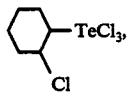

$n—C_{11}H_{23}—TeCl_3$, $C_2H_5OCH_2CH_2—TeCl_3$, $C_6H_5CH_2—TeCl_3$, $CH_3—C_6H_4—CH_2CH_2—TeCl_3$, $C_6H_5OC_6H_4—TeCl_3$, $C_6H_5—C_6H_4—TeCl_3$, and compounds obtained by substituting one or more chlorine atoms bonded to the tellurium atom of the above described compounds by a bromine or iodine atom, etc.

The organic tellurium compounds listed in the First Group and the Second Group are only a part of the compounds useful as image forming components in the present invention, and many other compounds may be used. For example, descriptions on examples of organic tellurium compounds and methods for the production thereof can be found in Kurt Irgolic & Ralph Zingaro, "Reactions of Organotellurium Compounds" in *Organometallic Reactions,* Vol. 2, Wiley-Interscience (1971), etc.

Third Group

Complexes formed by tellurium tetrachloride and an organic base, and represented by general formula (3).

$$Dn \cdot TeX_4 \quad (3)$$

wherein X represents a chlorine, bromine or iodine atom and the four halogen atoms can be the same or can be two or three different kinds of halogen atoms, D designates an organic base described in the following and *n* designates an integer of 1 to 6; compounds where $n=2$ are particularly important. The organic base includes an aliphatic amine compound, an aralkylamine compound, an aromatic amine compound, a nitrogen atom containing heterocyclic compound, etc.

Most preferred of the above compounds are aliphatic amines having 1 to 25 carbon atoms, aralkyl amines having 7 to 35 carbon atoms wherein the aryl moiety is phenyl, naphthyl or anthryl, aromatic amines having 6 to 35 carbon atoms wherein the aromatic ring is phenyl, naphthyl or anthryl and N-containing heterocyclic compounds having 5 or 6 members, such as compounds having a pyridine ring, pyridazine ring, pyrimidine ring, pyrazine ring, 1,3,5-triazine ring, pyrrole ring, quinoline ring, indole ring, carbozole ring, an aryl (phenyl or naphthyl) diazonium salt, etc., or derivatives thereof.

Specific examples of the organic base are those represented by the following general formulae (I) through (XII).

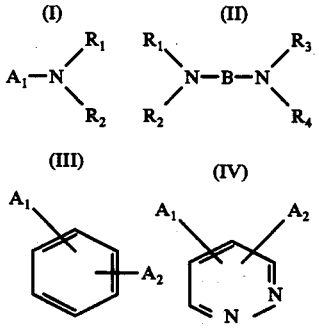

-continued

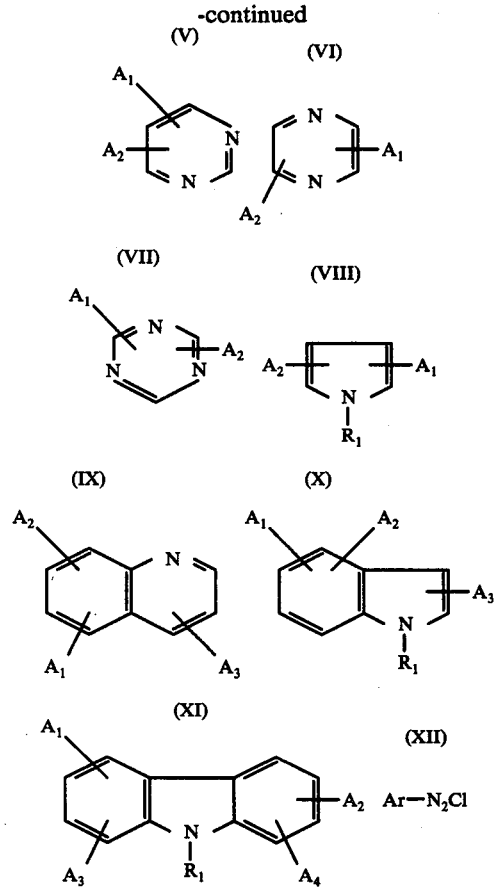

wherein $A_1$, $A_2$, $A_3$ and $A_4$ represent a hydrogen atom, an alkyl group (straight, branched or cyclic; which includes substituted ones), or an aryl group (which also includes substituted ones). Alkyl groups shown by $A_1$, $A_2$, $A_3$ and $A_4$ having 1 to 25 carbon atoms are especially useful; substituents include, for example, an alkoxy group having 1 to 5 carbon atoms, an aryl group such as phenyl, naphthyl, anthryl, etc., an aryloxy group such as phenoxy, naphthoxy, anthryoxy, etc., an aminoalkyl group where the alkyl moiety has 1 to 5 carbon atoms, an aminoaryl group where the aryl moiety is the same as the above defined aryl group, a sulfoalkyl group where the alkyl moiety has 1 to 5 carbon atoms, a sulfoaryl group where the aryl moiety is the same as above defined, a halogen atom, a halogenoaryl group wherein the aryl moiety includes phenyl, naphthyl or anthryl, etc. The aryl groups shown by $A_1$, $A_2$, $A_3$ and $A_4$ include a phenyl group, naphthyl group, anthryl group, phenanthryl group; substituents include an alkyl group having 1 to 20 carbon atoms, an aryl group the same as the above defined aryl group, an alkoxy group having 1 to 20 carbon atoms, an aryloxy group wherein the aryl moiety is the same as above defined, an acetyl group, a sulfoalkyl group where the alkyl moiety has 1 to 20 carbon atoms, a sulfoaryl group where the aryl moiety is as above defined, a halogenoalkyl group where the alkyl moiety has 1 to 20 carbon atoms, a halogenoaryl group where the aryl moiety is as above defined and an aralkyl group which is phenyl, naphthyl or anthryl group substituted with an alkyl group having 1 to 20 carbon atoms, etc.

Specific examples of groups shown by $A_1$, $A_2$, $A_3$ and $A_4$ include a methyl group, ethyl group, propyl group, isopropyl group, cyclopropyl group, butyl group, sec-butyl group, tert-butyl group, pentyl group, isopentyl group, neopentyl group, tert-pentyl group, hexyl group, isohexyl group, tert-hexyl group, cyclohexyl group, heptyl group, isoheptyl group, tert-heptyl group, methylcyclohexyl group, octyl group, isooctyl group, tert-octyl group, dimethylcyclohexyl group, nonyl group, tert-nonyl group, decyl group, tert-decyl group, undecyl group, tert-undecyl group, dodecyl group, tert-dodecyl group, tridecyl group, tert-tridecyl group, tetradecyl group, tert-tetradecyl group, pentadecyl group, sec-pentadecyl group, tert-pentadecyl group, hexadecyl group, tert-hexadecyl group, octadecyl group, sec-octadecyl group, tert-octadecyl group, nonadecyl group, sec-nonadecyl group, tert-nonadecyl group, eicosyl group, sec-eicosyl group, tert-eicosyl group, heneicosyl group, sec-heneicosyl group, tert-heneicosyl group, docosyl group, sec-docosyl group, tert-docosyl group, tricosyl group, sec-tricosyl group, tert-tricosyl group, tetracosyl group, sec-tetracosyl group, tert-tetracosyl group, pentacosyl group, sec-pentacosyl group, tert-pentacosyl group, ethoxyethyl group, ethoxypropyl group, ethoxybutyl group, ethoxypentyl group, ethoxyhexyl group, methoxyhexyl group, methoxyheptyl group, ethoxyheptyl group, methoxyoctyl group, ethoxyoctyl group, benzyl group, triphenylmethyl group, phenyl group, naphthyl group, tolyl group, xylyl group, mesityl group, hydroxyphenyl group, dihydroxyphenyl group, acetylphenyl group, benzophenonyl group, methoxyphenyl group, ethoxyphenyl group, nitrophenyl group, dinitrophenyl group, chlorophenyl group, bromophenyl group, trifuluoromethylphenyl group, biphenylyl group, phenoxyphenyl group, vinylphenyl group, sulfophenyl group, acetonaphthyl group, chloronaphthyl group, dichloronaphthyl group, hydroxynaphthyl group, methylnaphthyl group, methoxynaphthyl group, ethoxynaphthyl group, anthryl group, acetoanthryl group, chloroanthryl group, hydroxyanthryl group, dihydroxyanthryl group, methoxynaphthyl group, phenanthryl group, acetylphenanthryl group, methoxyphenanthryl group, dimethoxyphenanthryl group, and sulfophenanthryl group, etc.

Of the substituents for $A_1$, $A_2$, $A_3$ and $A_4$, particularly useful are hydrogen atoms; alkyl groups with 2 to 25 carbon atoms unsubstituted or substituted with an alkoxy group with 1 to 2 carbon atoms or a phenyl group; phenyl groups unsubstituted or substituted with an alkyl group with 1 to 2 carbon atoms, an alkoxy group with 1 to 2 carbon atoms, acetyl, trifluoromethyl, nitro, hydroxyl, acetophenonyl, phenoxy or phenyl groups or halogen atoms; naphthyl groups; anthryl groups; and phenanthryl groups.

In general formula (II), B designates a group which is divalent, e.g., an aliphatic hydrocarbon group, preferably an alkylene group, which may be straight or branched, and includes a substituted group, and further includes a substituted or non-substituted phenylene group or a double bond inserted in the straight chain, or an arylene group (which includes a substituted one). Useful aliphatic hydrocarbons having divalency shown by B are those having 1 to 10 carbon atoms; substituents include an alkoxy group having 1 to 5 carbon atoms, an aryl group such as a phenyl, naphthyl or anthryl group, an aryloxy group wherein the aryl moiety is as defined for the above aryl group, a nitro group, an amino group, an aminoaryl group wherein the aryl moiety is as defined for the above aryl group, an acetyl group and a halogen atom, etc., the groups to be inserted include a phenylene group, a substituted phenylene group, a naphthylene group, a substituted naphthylene group, a biphenylene group, a substituted biphenylene group, a carbonyldiarylene group, and a thiocarbonyldiarylene group, etc. Useful arylene groups shown by B include a phenylene, naphthylene, anthrylene and phenanthrylene group, and substituents include an alkyl group having 1 to 10 carbon atoms, an aryl group having 1 to 10 carbon atoms, an alkoxy group having 1 to 10 carbon atoms an aryloxy group wherein the aryl moiety is as above defined for the aryl moiety shown by B, a nitro group, an amino group, an aminoaryl group wherein the aryl moiety is as above defined for the aryl moiety shown by B, an aralkyl group which is phenyl, naphthyl or anthryl substituted with an alkyl group having 1 to 20 carbon atoms, a halogen atom, an acetyl group, an acetylaryl group where the aryl moiety is a moiety such as phenyl, naphthyl, or anthryl, and a hydroxyl group, etc.

Specific examples of the groups shown by B include an ethylene group, propylene group, butylene group, pentamethylene group, heptamethylene group, octamethylene group, nonamethylene group, decamethylene group, ethylethylene group, dimethylpropylene group, methylbutylene group, dimethylbutylene group, ethylbutylene group, methylpentamethylene group, dimethylpentamethylene group, ethylpentamethylene group, diethylhexamethylene group, phenylpropylene group, chlorophenylpropylene group, hydroxypentamethylene group, hydroxyheptamethylene group, methoxyheptamethylene group, methoxyoctamethylene group, ethoxynonamethylene group, ethoxydecamethylene group, chloropentamethylene group, chlorooctamethylene group, benzylbutylene group, benzylpropylene group, tolypentamethylene group, xylylbutylene group, xylylheptamethylene group, 4,4'-methylenediphenylene group, 4,4'-phenylmethylenediphenylene group, 4,4'-carbonyldiphenylene group, 4,4'-aminophenylmethylenediphenylene group, oxydiphenylene group, propenylene group, butenylene group, pentanylene group, heptenylene group, octenylene group, nonanylene group, decadienylene group, nonadienylene group, octadienylene group, heptadienylene group, phenylene group, chlorophenylene group, aminophenylene group, nitrophenylene group, methoxypehnylene group, phenylphenylene group, phenoxyphenylene group, aminophenylphenylene group, styrylpehnylene group, acetylphenylene group, acetylphenylphenylene group, aminophenacylphenylene group, bromophenylene group, oxyphenylphenylene group, biphenylene group, methylbiphenylene group, dimethylbiphenylene group, hydroxybiphenylene group, naphthylene group, acetonaphthylene group, methylnaphthylene group, dimethylnaphthylene group, hydroxynaphthylene group, phenanthrylene group, acetylphenanthrylene group, methylphenanthrylene group and methoxyphenanthrylene group, etc.

Particularly useful groups among those shown by B are non-substituted alkylene groups having 2 to 6 carbon atoms; 2 to 6 carbon atom containing alkylene groups substituted with a 1 to 2 carbon atom-containing alkoxy group, a phenyl group, an aminophenyl group, a halogen atom, a 1 to 2 carbon atom containing alkyl group or a hydroxyl group; a 2 to 6 carbon atom containing alkylene group inserted with a 2 to 6 carbon atom containing monoene, diene, triene or arylene group, i.e., $-(CH_2)_n-Y-(CH_2)_m-$, wherein $n+m=$ 2–6, Y representing monoene, diene, triene or arylene, a 4,4'-methylenediphenylene group, a 4,4'-carbonyldiphenylene group, an oxydiphenylene group, or a diphenylene group; a phenylene group; a phenylene group substituted with a 1 to 2 carbon atom containing alkyl group, a 1 to 2 carbon atom containing alkoxy group, an acetyl group, a halogen atom, a trifluoromethyl group, a nitro group, a hydroxyl group, an acetophenonyl group, a phenoxy group, an amino group, an aminophenyl group, a nitrophenyl group, a halogenophenyl group, a hydroxyphenyl group or a phenyl group; a naphthylene group; an anthrylene group; and a phenanthrylene group.

In general formula (XII), Ar designates an aryl group. The aryl group can be non-substituted or substituted with an alkyl group having 1 to 10 carbon atoms, a hydroxyl group, an alkoxy group having 1 to 10 carbon atoms, an aryloxy group such as phenoxy, naphthoxy or anthryloxy, an aminoalkyl group where the alkyl moiety has 1 to 5 carbon atoms, such as phenylamino, naphthylamino or anthrylamino, a cyano group, a nitro group, a carboxyl group, a sulfo group, or a halogen atom. The aryl group includes a phenyl group, naphthyl group, anthryl group and phenanthryl group.

In the formula, $R_1$, $R_2$, $R_3$, and $R_4$ may be the same or different from each other, and each represents a hydrogen atom, an alkyl group or an aryl group. The alkyl group may be straight, branched or cyclic. Useful alkyl groups are those containing 1 to 6 carbon atoms and useful aryl groups are a phenyl group and a naphthyl group. The alkyl group (which may be substituted with one or more halogen atoms) and aryl group may further be substituted with an aminoalkyl group wherein the alkyl moiety has 1 to 10 carbon atoms, an aminoaryl group such as an aminophenyl or aminonaphthyl group, an alkoxy group having 1 to 10 carbon atoms or a halogen atom. The aryl group may further be substituted with an alkyl group having 1 to 10 carbon atoms. The groups shown by $R_1$, $R_2$, $R_3$, and $R_4$ can include, for example, methyl group, ethyl group, propyl group, butyl group, hexyl group, octyl group, pentyl group, cyclopentyl group, cyclohexyl group, chloroethyl group, phenyl group, styryl group, p-methoxyphenyl group, p-chlorophenyl group, p-nitrophenyl group, napthyl group, p-aminophenyl group, aminonaphthyl group, tolyl group, and a hydrogen atom. Particularly useful groups shown by $R_1$, $R_2$, $R_3$ and $R_4$ are 1 to 2 carbon atom containing alkyl groups non-substituted or substituted with a chlorine atom or a phenyl group; a phenyl group non-substituted or substituted with an alkoxy group having 1 to 10 carbon atoms, a nitro group or an amino group; and a hydrogen atom.

Substitutents $A_1$, $A_2$, $A_3$, $A_4$, Ar, B, $R_1$, $R_2$, $R_3$ and $R_4$ in the compounds shown by general formulae (I) through (XII) are not limited to those described above, and any substituent can be included so long as the compound will form a complex with a tellurium halide.

Specific examples of the compounds are ethylamine, propylamine, butylamine, tert-butylamine, pentylamine, isopentylamine, hexylamine, heptylamine, octylamine, nonylamine, decylamine, tert-decylamine, undecylamine, dodecylamine, tetradecylamine, pentadecylamine, octadecylamine, nonadecyl amine, eicosylamine, docoxylamine, tricosylamine, tetracosylamine, pentacosylamine, ethoxyethylamine, ethoxypropylamine, ethoxybutylamine, ethoxypentylamine, ethoxyhexylamine, methoxyhexylamine, methoxyoctylamine, methoxyeicosylamine, methoxytricosylamine, benzylamine, tritylamine, phenethylamine, vanillylamine, veratrylamine, poly(p-aminostyrene), N-methyethylamine, N-methylpropylamine, N-methylbutylamine, N-methyl-tert-butylamine, N-methylheptylamine, N-methyloctylamine, N-methylnonylamine, N-methyl-tert-decylamine, N-methyloctadecylamine, N-methylethoxybutylamine, N-methylmethoxyhexylamine, N-methylmethoxyeicosylamine, N-methylbenzylamine, n-methyltrimethylamine, N-methylphenethylamine, N-methylvanillylamine, N-methylveratrylamine, N-ethylbutylamine, N-ethylphentylamine, N-ethyldecylamine, N-ethyldodecylamine, n-ethyloctadecylamine, N-ethyleicosylamine, N-ethyldococylamine, N-ethyltetracocylamine, N-ethylpentacocylamine, N-ethylethoxyhexylamine, N-ethylmethoxyhexylamine, N-ethylbenzylamine, N,N-dimethylethylamine, N,N-dimethylpropylamine, N,N-dimethylbutylamine, N,N-dimethyl-tert-butylamine, N,N-dimethylheptylamine, N,N-dimethyloctylamine, N,N-dimethylnonylamine, N,N-dimethylmethoxyhexylamine, N,N-dimethylmethoxyeicosylamine, N,N-dimethylphenethylamine, N,N-dimethylvanillylamine, N,N-dimethylveratrylamine, N,N-diethylvanillylamine, N,N-diethylpropylamine, N,N-diethylbenzylamine, N,N-dimethylbenzylamine, aniline, nitroaniline, trifluoromethylaniline, toluidine, ethylaniline, chloroaniline, bromoaniline, methyl aminobenzoate, butylaniline, phenylaniline, naphthylaniline, dinitroaniline, naphthylamine, methoxyaniline, acetylaniline, N-methylaniline, N-ethylaniline, N,N-dimethylaniline, N,N-diethylaniline, N-methylnitroaniline, N,N-dimethylnitroaniline, N,N-diethylnitroaniline, N,N-dimethyltoluidine, N,N-dimethylacetylaniline, N,N-dimethylmethoxyaniline, N,N-dimethylnaphthylamine, N,N-dimethyltrifluoroaniline, p-n-dodecylaniline, ethylenediamine, propylenediamine, butylenediamine, ethylethylenediamine, methyltrimethylenediamine, propenylenediamine, hexadienylenediamine, phenyltrimethylenediamine, diaminodiphenylmethane, diaminobenzophenone, napthylenediamine, benzidine, oxydiphenylenediamine, phenylenediamine, methylphenylenediamine, ethylphenylenediamine, N,N,N',N'-tetramethylphenylenediamine, N,N,N',N'-tetramethyl-oxydiphenylenediamine, N,N,N',N'-tetramethyl-4-4'-methylenedianiline, N,N,N',N'-tetramethyldiaminobenzophenone, N,N,N',N'-tetramethylbenzidine, N,N,N',N'-tetramethylethylenediamine, N,N,N',N'-tetramethylhexamethylenediamine, N,N,N',N'-tetramethylpropanediamine, N,N,N',N'-tetramethyltrimethylenediamine, diaminopyridine, methylpyridine, dimethylpyridine, pyridine methanol, pyridine ethanol, pyridine carboxylic acid methyl ester, pyrazine, methylpyrazine, ethylpyrazine, pyrazine dicarboxylic acid methyl ester, trimethylpyrazine, pyrimidine, 5-methylpyrimidine, methoxypyrimidine, 5-hydroxypyrimidine, methylpyridazine, methoxypyridazine, phenylpyridazine, ethylpyridazine, triazine, pyrrole, N-methylpyrrole, acetylpyrrole, dinitropyrrole, tetramethylpyrrole, dipyrilmethane, N-methylacetylpyrrole, indole, β-aminoethylindole, methylindole, methoxyindole, N-methylindole, N-methylmethylindole, dimethylindole, carbazole, N-methylcarbazole, N-ethylcarbazole, N-methylacetylcarbazole, N-methyldiacetylcarbazole, N-methylnitrocarbazole, N-propylcarbazole, aminocarbazole, quinoline, quinolinemethanol, chloroquinoline, methoxyquinoline, nitroquinoline, aminoquinoline, benzenediazoniumchloride, p-nitrobenzenediazoniumchloride, methylbenzenediazoniumchloride, chlorobenzenediazoniumchloride, cyanobenzenediazoniumchloride, acetylbenzenediazoniumchloride, and p-N,N-dimethylaminobenzenediazoniumchloride, etc. One or more of these organic bases can be used as the occasion demands.

To synthesize the complex used in the present invention the procedures described by A. Lowy & P. F. Dunbrook, *Journal of the American Chemical Society,* vol. 44, p 614 (1922); S. Prasad & B. L. Khandelwal, *Journal of the Indian Chemical Society,* vol. 38, p 837 (1961); R. Korewa, *Roczniki Chemistry,* vol. 37, p 1565 (1963); and E. A. Boudreaux, *Journal of the American Chemical Society,* vol. 85, p 2039 (1963); etc., can be used.

A simple test does exist to enable one skilled in the art to identify most preferred tellurium compounds for use in the present invention. More specifically, a mixture of the organic tellurium compound and a light-sensitive image forming compound (such as e.g., 4-methoxy-1-naphthol) is heated at 110°–150° C. If the mixture becomes dark, the organic tellurium compound is useful. It should be noted, however, that organic tellurium compounds which do not darken in accordance with the above test can also be employed in combination with other organic tellurium compounds which do become dark under the above testing conditions.

In the following, examples of synthesis of representative compounds are given.

Synthesis Example (1)

A complex of ethylenediamine and tellurium tetrachloride: $C_2H_4(NH_2)_2.TeCl_4$.

6.75 g (0.025 mole) of tellurium tetrachloride and 50 ml of chloroform were put into a flask having a volume of 200 ml equipped with a stirring means and a dropping means, then a solution of 1.65 g (0.0275 mol) of ethylene diamine and 50 ml of chloroform was dropped therein while stirring. After dropping, the solution was further stirred at room temperature (about 25° C) for 1 hour, and a precipitate obtained was separated by filtration. The precipitate was then rinsed with chloroform until the filtrate did not form a complex with chloroform, and then dried. 7.8 g (yield 94%, light yellow powder, decomposed at a temperature not less than 150° C) of product was obtained.

Synthesis Example (2)

A complex of p-nitrobenzenediazoniumchloride and tellurium hexachloride: $(O_2NC_6H_4N_2)_2.TeCl_6$.

A saturated ethyl alcohol solution of p-nitrobenzenediazoniumchloride obtained from p-nitroaniline in absolute alcohol according to the method by Koenings (Ann., vol. 509, p 149 (1934) ) was added to a saturated ethyl alcohol solution of tellurium tetrachloride in an amount such that the molar ratio of the diazonium salt to tellurium tetrachloride was 2, and then stirred at room temperature (about 25° C) for about one hour. The precipitate obtained was separated by filtration. The predipitate was then rinsed with ether, and then dried at a low pressure to obtain the complex $(O_2NC_6H_4N)_2$—$TeCl_6$ having a melting point of 121° C in a qualitative yield. The process was carried out in the dark.

The film forming binders used for the present invention are conventional and include the following. While not to be construed as limitative, on a commercial scale generally the binders utilized in the present invention will have a molecular weight of from about 5,000 to about 1,000,000, even more preferably from 10,000 to 50,000.

One type of binder is soluble in an organic solvent; such includes polyvinyl formal, polyvinyl butyral, polyvinyl acetate, polyvinyl chloride, a copolymer of vinyl chloride and vinyl acetate, a copolymer of vinylidene chloride and a coopolymer of vinlidene chloride and acrylonitrile, a partly or fully hydrolyzed polyvinyl acetate or a vinyl acetate copolymer, a polymer of acrylonitrile or acrylamide, polymethacrylic acid ester, polyacrylic acid ester, polyethylene, cellulose ether, cellulose ester, or carboxymethyl cellulose, etc. Of these binders a copolymer of vinyl chloride or vinyl chloride (vinyl chloride content not less than 80 mol%) and vinyl acetate, polyvinyl butyral, polyvinyl formal and an ethoxy cellulose derivative, e.g., ethyl cellulose, are particularly advantageous in that image density and developing speed are increased, and the light-sensitive layer does not adhere to the receiving layer when heated.

Another type of the binder is water soluble and includes gelatin, polyvinyl pyrrolidone, polyvinyl alcohol, sodium alginate, etc.

A suitable amount of the binder is about 0.8 to about 15 parts, preferably 1 to 8 parts, per one part of organic tellurium compound (unless otherwise indicated, all "parts" in the present application are weight parts).

The solvent used for the present invention includes organic solvents known to one skilled in the art such as esters, alcohols, ketones, aromatic hydrocarbons (such as N,N-dimethylformamide, tetrahydrofuran, 1,4-dioxane, ethanol, isopropanol, chloroform, methylene chloride, 1,2-dichloroethane, trichloroethane, ethyl acetate or methyl acetate), and, besides, these, amides such as N,N-dimethylformamide, dimethylacetoamide, dodecylamide, etc., ethers such as tetrahydrofuran, 1,3-dioxane, 1,4-dioxane, etc., can be used. These organic solvents desirably dissolve the organic tellurium compound; however, when the organic tellurium compound is hard to dissolve, the organic tellurium compound can be dissolved in a solvent which easily dissolves the organic tellurium compound, and then the solution added to a solvent which hardly or does not dissolve (such as N,N-dimethylformamide, tetrahydrofuran, 1,4-dioxane, ethanol, isopropanol, chloroform, methylene chloride, 1,2-dichloroethane, trichloroethane, ethyl acetate, or methyl acetate) the organic tellurium compound under vigorous stirring to finely disperse the organic tellurium compound. This dispersing method is also effective in the case of using a water soluble binder, and in this case a surface active agent having a known suitable HLB may be used. Most preferred surface active agents are those having an HLB value of from about 8 to about 18. The weight ratio of the binder to the solvent depends on the molecular weight, etc., of the binder polymer, and cannot be set forth unequivocally, however, in general, a range of about 0.02 to about 0.5, particularly 0.07 to 0.3, can be employed (weight ratio of binder/solvent).

The support used for the present invention is conventional and can be the same or different for the light-sensitive layer and the image receiving layer, and includes the following: paper, baryta paper, coated paper, e.g., coated with a white pigment (such as $TiO_2$, $Al_2O_3$ etc.), or a resin, etc., paper laminated with a polymer (e.g., polyethylene, vinylidene chloride, regenerated cellulose, etc.), a polyester film, a cellulose ester film, a nylon film, a polycarbonate film, a polyimide film, glass, etc.

A plasticizer can be added to the binder, if desired. A plasticizer provides a suitable softness to the film forming binder to prevent cracking or brittleness, and, at the same time, in the image formation method of the present invention, increases the speed of image formation by heating, and, as a result, image density is increased by heating for a short period of time. Also image contrast is increased without increasing fog density at non-image areas.

Suitable plasticizers having these particular effects are ester plasticizers such as tricresyl phosphate, triphenyl phosphate, butylphthalylbutylglycolate, butyl phthalate, etc., straight chain or branched alkylamines such as stearylamine, laurylamine, behenamine,etc., alkyl amides such as stearylamide, behenamide, laurylamide, etc. These amines and amides also have the effect of promoting a reduction of the organic tellurium compounds by raising the reactivity of the organic telluriam compound and the reducing agent, etc. Glycolate derivatives such as ethylphthalylethylglycolate, ethylphthalylbutylglycolate, butylphthalylbutylglycolate, etc., and alkyl amines are particularly desired since image density is extremely increased and developing speed is also increased. On the other hand, many polyethylene glycols having a molecular weight of about 500 to about 20,000 were tested; however, their effects as plasticizers were poor since the increase of image density and development speed were small as compared with the above described plasticizers.

The plasticizers having the above described particular effects can be used in an amount ranging from about 10 to about 120% by weight of the dry binder, and, in particular, the increase of image density and developing speed are large and thermal stability of the binder layer is good. Further coloring of the binder layer is small when the plasticizer is used in an amount ranging from 20 to 60% by weight of the dry binder.

The auxiliary reducing agents which can optionally be used in the image receiving layer in the method of the present invention are listed in the following (A), (B), (C) and (D). One or more can be used at the same time.

(A) Compounds where one or more hydrogen atoms, usually a maximum of two hydrogen atoms, of an aromatic ring of an aryl group such as phenyl, naphthyl or anthryl [e.g., benzene, naphthalene, anthracene, biphenyl, diphenylmethane, diphenylalkylmethane in which the alkyl group bonded to the central carbon atom is a methyl group, ethyl group] are substituted with at least one group or groups represented by $—OR_1$ and/or $—NR_2R_3$, wherein $R_1$ represents a hydrogen atom, an alkyl group or an alkenyl group, most preferably an alkyl group or an alkenyl group having 1 to 20 carbon atoms; straight, branched or cyclic, a substituted alkyl group where the alkyl moiety has 1 to 20 carbon atoms and a substituted alkenyl group (1 to 20 carbon atoms containing; straight, branched or cyclic), where substituents for both include a halogen atom, hydroxyl group, an alkoxy group, an alkoxy group containing 1 to 10 carbon atoms, an acetyl group, a phenyl group, a naphthyl group, a phenoxy group, and a phenyl group, naphthyl group, or phenoxy group substituted with an alkyl group or haloalkyl group, where the alkyl group has 1 to 5 carbon atoms and the haloalkyl group comprises an alkyl moiety of 1 to 5 carbon atoms and wherein the halogen is Cl or Br, etc. Of these, a hydrogen atom, a methyl group and an ethyl group are particularly important as $R_1$.

Further, $R_2$ and $R_3$ can be the same or different from each other, and represent a hydrogen atom, an alkyl group or an alkenyl group (1 to 20 carbon atoms for both straight, branched or cyclic), a substituted alkyl group and a substituted alkenyl group (the carbon atom numbers and the substituents are the same as for the substituted alkyl group and the substituted alkenyl group of the above described $R_1$), an aryl group (e.g., a phenyl group, a naphthyl group, an anthryl group, a biphenyl group, etc.) and a substituted aryl group (substituents include a 1 to 10 carbon atom containing straight, branched or cyclic alkyl group or alkenyl group; a 1 to 10 carbon atom containing straight, branched or cyclic alkyl group or alkenyl group substituted with a halogen atom, a hydroxyl group, or an alkoxy group having 1 to 5 carbon atoms, etc.; a halogen atom; a hydroxyl group; a 1 to 10 carbon atom containing straight, branched or cyclic alkoxy group; a 1 to 10 carbon atom containing alkoxy group substituted with a halogen atom, a hydroxyl group, or an alkoxy group having 1 to 5 carbon atoms, etc.; an acyl group having 1 to 5 carbon atoms, preferable an acetyl group; a benzoyl group; a phenyl group; a naphthyl group; a phenoxy group; a phenyl group, naphthyl group or phenoxy group substituted with a 1 to 10 carbon atom containing alkyl group, a haloalkyl group having 1 to 10 carbon atoms, etc.; an amino group; an alkylamino group where the alkyl moiety has 1 to 10 carbon atoms, etc.), etc.

Specific examples of these compounds are phenol, anisole, hydroquinone, catechol, resorcin, pyrogallol, p-methoxyphenol, m-butoxyphenol, 2,6-dimethoxyphenol, methoxyhydroquinone, ethoxyhydroquinone, α-naphthol, β-naphthol, 4,4'-dihydroxybiphenyl, aniline, N,N-dimethylaniline, N,N-diethylaniline, N-methylaniline, o-phenylenediamine, p-N,N-dimethylaminoaniline, 4-aminodiphenylamine, diphenylamine, triphenylamine, 1,5-diaminonaphthalene, 2-phenyl-1-naphthylamine, 1,4-diaminoanthracene, 1,2-diaminonaphthalene, 4-aminobiphenyl, 4,4'-diaminobiphenyl, p-aminophenol, m-aminophenol, o-aminophenol, 2,4-diaminophenol, N-methyl-p-aminophenol, p-methoxyaniline, N-benzylaniline, p-methoxy-N-benzylaniline, etc.

(B) Compounds in which the compound described in (A) is substituted with at least one substituent listed in the following. Examples of the substituent include an alkyl group and an alkenyl group (both containing 1 to 20 carbon atoms; straight, branched or cyclic), a substituted alkyl group or substituted alkenyl group (both containing 1 to 20 carbon atoms, straight, branched or cyclic; substituents include a hydroxyl group, an alkoxy group containing 1 to 10 carbon atoms, a halogen atom, a cyano group, an acetyl group, a phenyl group, a napthyl group, a phenoxy group, and a phenyl group, naphthyl group or phenoxy group substituted with an alkyl group containing 1 to 5 carbon atoms, or a halogen atom, etc., etc.), a halogen atom, an acetyl group, a benzoyl group, a nitro group, a nitroso group, a cyano group, a phenyl group, a naphthyl group, a phenoxy group, and a substituted phenyl naphthyl or a phenoxy group (substituents include a 1 to 10 carbon atom containing: alkyl group, haloalkyl group or alkoxy group) an aldehyde group, a carboxyl group, a $-COOR_4$ group ($R_4$ represents a 1 to 5 carbon atom containing straight or branched chain: alkyl group, hydroxyalkyl group or alkoxyalkyl group, etc.), etc.

Specific examples of these compounds are p-cresol, p-tert-butyl cresol, p-tert-oxtylphenol, 2,4-di-tert-butylphenol, p-acetylphenol, p-phenylphenol, o-phenylphenol, 2,3-xylenol, 2,4-xylenol, 2,5-xylenol, 2,6-xylenol, 2,4,5-trimethylphenol, 2,3,5,6-tetramethylphenol, 2-acetyl-p-aminophenol, o-nitrophenol, resorcinol-monoacetate, 2,6-dimethyl-N,N-dimethylaminophenol, p-hydroxybenzaldehyde, 3,4-dihydroxybenzaldehyde, phenylhydroquinone, 2,3-dimethylhydroquinone, 2,5-dimethylhydroquinone, 2,6-dimethylhydroquinone, ethylhydroquinone, tert-butylhydroquinone, 2,5-di-tert-butylhydroquinone, t-octylhydroquinone, 2,5-di-n-oxtylhydroquinone, 2,5-di-tert-octylhydroquinone, decylhydroquinone, 2,4-dihydroxyacetophenone, tetrachlorohydroquinone, 3,4-dihydroxytoluene, n-butylhydroxytoluene, 2,4',4,4'-tetrahydroxydiphenyl, $\gamma$-resorcylic acid, gallic acid, protocatechuic acid, methyl protocatechuate, ethyl gallate, n-propyl gallate, dodecyl gallate, stearyl gallate, o-hydroxybenzoic acid, syringic acid, gentisic acid, ethyl p-hydroxybenzoate, 2,3-dihydroxybenzoic acid, 2,4-dihydroxybenzoic acid, 2,5-dihydroxybenzoic acid, ethyl p-aminobenzoate, 2,3-cresotinic acid, o-thymotinic acid, pyrogallolcarboxylic acid, 4-hydroxy-3,5-dimethoxybenzoic acid, 2-hydroxy-3-methylbenzoic acid, $\alpha$-nitroso-$\beta$-naphthol, 1-hydroxy-2-naphthoic acid, 2-hydroxy-3-naphthoic acid, 1-naphthylamine-7-sulfonic acid, sodium 1-amino-2-naphthol-6-sulfonate, 2-methyl-4-methoxynaphthol, 2-phenyl-4-methoxynaphthol, 2-hydroxy-1-naphthoaldehyde, 1,1'-dihydroxy-2,2'-binaphthyl, 2-tert-butyl-4-methoxyphenol, bisphenol A, 2,6-ditert-butyl-p-cresol, bis(2-hydroxy-1-napthyl)methane, bis(2-hydroxy-3-tert-butyl-5-methylphenyl)methane, bis(2-hydroxy-3,5-di-tert-butylphenyl)methane, 4,4'-methylenebis(3-methyl-5-tert-butylphenol), 4,4'-methylenebis(2,6-di-tert-butylphenol), 2,2'-methylenebis(2-tert-butyl-4-ethylphenol), etc. Of these, many examples of steric rotation prohibited phenols are described in U.S. Pat. No. 3,218,166 as are useful in the present invention; p-chloroaniline, p-methylaniline, p-acetylaniline, tolylene-2,4-diamine, 2,6-diaminotoluene, p-methyl-N,N-dimethylaniline, 2,6-dichloromethylaniline, 4,4'-N,N,N',N'-tetramethyldiaminodiphenylmethane, 4,4',4''-N,N,N',N'', N''-hexamethyltriaminotriphenylmethane, 2-ethyl-1,4-diaminonaphthalene, 3,4-xylidine, etc., can also be included.

(C) Compounds as described in the following.

Benzoin, dihydroxyacetate, glyceric aldehyde, 1-naphthohydroxamic acid, kojic acid, N,N-di(2-ethoxyethyl)-hydroxylamine, bis(3-methyl-4-hydroxy-5-tert-butylphenyl)-sulfide, 2,2',4,4'-terrahydroxydiphenylsulfide, N,N'-bis(m-hydroxyphenyl)urea, 1,3-diphenyl-2-thiourea, ethyleneglycol-bis-(m-hydroxyphenyl)ether, m,m'-dihydroxyoxanilide, methyleneaminoacetonitrile, etc.

(D) Salts of reductive metal ions.

Inorganic salts and organic salts of metal ions having a low valence state, i.e., a metal ion capable of assuming at least two valence states (such as Fe ion which can exhibit the valence states (II) and (III)) such as iron (II), tin (II), titanium (III), chromium (II), cobalt (II), manganese (II), copper (I), etc. The inorganic salts are salts of the metal ion having low valence state and a halogen anion, an anion derived from a mineral acid (such as $NO_3^-$, $SO_4^-$), or thiocyanic acid ($SCN^-$), and preferred examples are $FeCl_2$, $CoCl_2$, $FeBr_2$, $CrBr_2$, $Mn(SCN)_2$, $Fe(NO_3)_2$, $CuS)_4$ etc. The organic salt comprises a metal the same as above e.g., a salt of citric acid, oxalic acid or tartaric acid; preferred examples include cobalt citrate, ferrous citrate, ferrous oxalate, chromium tartarate, etc. From these compounds those having a suitable reducing ability can be selected depending on the oxidizing ability of the organic tellurium compound. One or more compounds can be used at the same time.

A suitable amount of the auxiliary reducing agent differs depending on the reducing ability thereof, however, in general, about 0.01 to about 10 moles, preferably 0.1 to 2 moles, per one mole of the organic tellurium compound is exmployed.

In the image receiving layer for the present invention there can be added an anti-fogging agent or a whitening agent. The anti-fogging agent is used to prevent non-image areas (that is, the areas of the image receiving layer to be heated in contact with the exposed areas of the light-sensitive layer, and no colored substance must be formed in these areas since the image forming compound in the light-sensitive layer is changed to a non-transferable form by exposure) from coloring, that is, to lower the optical density due to fogging by heating only. On the other hand, the whitening agent is used to increase the whiteness of non-image areas of the image receiving layer by the reflection of light. The anti-fogging agent and the whitening agent decrease the optical density of non-image areas, and, as a result, increase image contrast.

Examples of the anti-fogging agent are various oxidizing substances such as tetrachlorophthalic anhydride, tetrabromophthalic anhydride, N-bromosuccinimide, benzoyl peroxide, t-butylhydroperoxide, chloranil, bromanil, iodanil, carbon tetrabromide, bromotrichloromethane, dibromodiiodomethane, carbon tetraiodide, 1,3,5-trinitrobenzene, m-dinitrobenzene, phthalonitrile isophthalonitrile, terephthalonitrile, 1,2,4,5-tetracyanobenzene, tetracyanoethylene, tetracyanoquinodimethane, phenyltribromomethylsulfone, 9-fluorenone, 2,4,7-trinitro-9-fluorenone, palladium chloride, palladium-acetylacetone complex, palladium-benzoylacetone complex, palladium-benzoylmethane complex, chloroauric acid and alkali metal salts thereof, alkali metal salts of chloroplatinic acid, silver chloride, silver bromide, silver iodide, etc.

A suitable amount of the anti-fogging agent ranges from about 0.01 to about 2.0 moles, preferably 0.1 to 1.0 mole, per one mole of the organic tellurium compound.

The whitening agents include silicon dioxide, zinc oxide, titanium dioxide, magnesium oxide, alumina, barium sulfate, or other white metal oxides or salts. Further, these substances have an effect to decrease the adhesivity of the image receiving layer so that the image receiving layer does not adhere to the light-sensitive layer when they are contacted and heated after image-wise exposure of the light-sensitive layer.

A suitable amount of the whitening agent ranges from about 0.1 to about 50, preferably 0.2 to 2.0 parts, by weight per one part by weight of the organic tellurium compound. Preferred whitening agent have a size of from about 0.1 $\rho$ to about 1 $\mu$.

In the following, methods of producing the light-sensitive layer and the image receiving layer used for the method of the present invention are described.

Predetermined components, that is, an image forming compound, a sensitive agent, and a binder, etc., for the light-sensitive layer, and an image forming compound (an organic tellurium compound), an auxiliary reducing agent, an anti-fogging agent and/or a whitening agent, and a binder, etc., for the image receiving layer, are dissolved or dispersed into a solvent(s) and the thus obtained coating solutions are coated on supports. Coating can be carried out using methods known to one skilled in the art such as rod coating, roller coating, curtain coating, Lip coating, and the like. After coating, the coated layer is dried at a temperature ranging, in general, from about 30° to about 100° C, more preferably 40° to 80° C.

A suitable thickness of the light-sensitive layer or the image receiving layer obtained on the support after drying can range, in general, from about 0.1 to about 100 $\mu$, preferably 0.5 to 20 $\mu$.

The copying method of the present invention is described in the following. Exposure of the light-sensitive layer can be effected by exposing the light-sensitive layer in contact with an original or using an optical system, or by exposing the light-sensitive layer in contact with an original using light reflected from the original. For exposure, a light source which radiates visible or ultraviolet light such as a tungsten lamp, xenon lamp, mercury lamp, or carbon arc lamp, etc., can be used. Conventionally, the exposure conditions used involve an exposure intensity of from about 1 lux. second to about $10^5$ lux. second. If a one Kw xenon lamp is used for the exposure at a distance of 30 cm, for example, the exposure time is conventionally from about 0.1 second to about 1 minute and 40 seconds.

After exposure of the light-sensitive layer, the light-sensitive layer is contacted with the image receiving layer and uniformly heated to transfer the image forming compound at the non-exposed areas of the light-sensitive layer to the image receiving layer to form a color image in the image receiving layer. The heating for the transfer and the image function is carried out at a temperature, in general, ranging from about 80° to about 200° C, more preferably 100° to 150° C. A suitable heating time differs depending on the heating temperature and the desired image density, however, in general, a range from about 1 to about 100 sec., preferably 5 to 60 sec., is usually employed. Methods of heating include heating the exposed light-sensitive layer contacted with the image receiving layer on a hot plate heated to a predetermined temperature, with a heat radiation source such as an infrared lamp, or by passing over a heated roller or rollers. The light-sensitive layer and the image receiving layer are then separated. When a positive original is used, a positive image is obtained.

The following examples are given to illustrate the present invention in greater detail. Unless otherwise indicated, all parts, percents, ratios and the like are by weight. In the following examples, the thickness of any image-receiving layer was 10 $\mu$, unless otherwise indicated.

EXAMPLE 1

A light-sensitive layer was produced as follows.

0.05 parts of 1-hydroxy-4-methoxynaphthalene (image forming compound), 0.02 part of erythrosine (sensitizing agent) and 2.5 parts of ethylcellulose (binder) were dissolved in 100 parts of butanone-2 (solvent). The thus obtained coating solution was coated on a glassine paper (support) using a rod coating machine to obtain a dry coating amount of about 1.8 g/m$^2$, and then dried at 60° C for 30 min.

On the other hand, an image receiving layer was produced as follows.

3 parts of tellurium bisacetophenonedichloride, that is, $(C_6H_5COCH_2)_2TeCl$ (image forming component), 1 part of tetradecylamine-tellurium tetrachloride complex (image forming component) and 25 parts of polyvinyl chloride (binder) were dissolved in 250 parts of N,N-dimethylformanide (solvent). The thus obtained coating solution was coated on a paper (support) of 40g/m$^2$ using a rod coating machine, and then dried at 60° C for 30 min. The thickness of the image receiving layer thus obtained on the support was about 10 $\mu$.

The thus obtained light-sensitive layer was imagewise exposed using contact reflection exposure using an original printed matter having an optical reflection density of 2.0 at black areas and 0.01 at the white background areas. The light source was 1 KW xenon lamp, and the distance between the light source and the light-sensitive layer was 30 cm; the exposure time was 30 sec. The above image receiving layer was then superimposed on the light-sensitive layer and then placed on a hot plate at 150° C to heat it. After heating for 50 sec., the light sensitive layer was removed to obtain a positive copy on the image receiving layer. The color of the image was black-blue, and the optical reflection density (mean value within the visible range) was 0.50; on the other hand, the optical reflection density of the non-image areas was 0.10, providing an image having distinct contrast.

EXAMPLES 2 - 14

Image receiving layers were produced by dissolving organic tellurium compounds (image forming component) listed in the following table and 20 parts of polyvinyl chloride in 200 parts of N,N-dimethylformamide and coating the thus obtained solution on paper in the same manner as described in Example 1. Copying was carried out using the light-sensitive layer of Example 1 following the procedure of Example 1; the results are shown in the following table.

Table

| Ex. | Organic Tellurium Compound | | Optical Density of Image Areas | Optical Density of Non-Image areas |
|---|---|---|---|---|
| 2 | $(C_6H_5COCH_2)_2TeCl_2$ | 5 parts | 0.35 | 0.02 |
| 3 | $(\alpha\text{-}C_{10}H_7COCH_2)_2TeCL_2$ | 5 parts | 0.30 | 0.02 |
| 4 | $(p\text{-}O_2N—C_6H_4COCH_2)_2TeCl_2$ | 5 parts | 0.32 | 0.02 |
| 5 | $(p\text{-}CH_3O—C_6H_4COCH_2)_2TeCl_2$ | 5 parts | 0.32 | 0.02 |
| 6 | $(p\text{-}CH_3—C_6H_4COCH_2)_2TeCl_2$ | 5 parts | 0.34 | 0.02 |
| 7 | 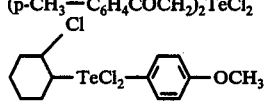 | 5 parts | 0.33 | 0.03 |
| 8 | 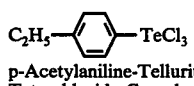 | 6 parts | 0.28 | 0.05 |
| 9 | p-Acetylaniline-Tellurium Tetrachloride Complex | 4 parts | 0.40 | 0.10 |
| 10 | p-Trifluoromethylaniline-Tellurium Tetrachloride Complex | 4 parts | 0.45 | 0.07 |
| 11 | Dodecylamine-Tellurium Tetrachloride Complex | 3 parts | 0.40 | 0.05 |
| 12 | Stearylamine-Tellurium Tetrachloride Complex | 3 parts | 0.45 | 0.05 |
| 13 | Stearylamine-Tellurium Tetrabromide Complex | 3 parts | 0.37 | 0.40 |
| 14 | $(p\text{-}CH_3CO—C_6H_4COCH_2)_2—TeCl_2$ and Stearylamine-Tellurium Tetrachloride Complex | 3 parts<br>2 parts | 0.55 | 0.10 |

EXAMPLE 15

An image receiving layer was produced in the same manner as described in Example 1 except that 2.4 parts of 1,1'-bis(2-hydroxy-3-tert-butyl-5-methylphenyl)methane (auxiiliary reducing agent) was further added. Copying was carried out using the light-sensitive layer of Example 1 in the same manner as described in Example 1. An optical density of 0.72 at image areas and 0.22 at non-image areas was obtained. That is, by the use of the auxiliary reducing agent image density increased but the density of non-image areas, that is, fog, also increased.

EXAMPLES 16 - 21

Image receiving layers were obtained in the same way as Example 15 except that the auxiliary reducing agents listed in the following table were used instead of the auxiliary reducing agent of Example 15. Copying was carried out in the same manner as described in Example 15 and the results shown in the following table were obtained.

Table

| Example | Auxiliary Reducing Agent | | Optical Density at Image Areas | Optical Density at Non-Image Areas |
|---|---|---|---|---|
| 16 | Bisphenol A | 2.4 parts | 0.60 | 0.15 |
| 17 | β-Naphthol | 2.4 " | 0.65 | 0.20 |
| 18 | p-t-Octylphenol | 2.4 " | 0.66 | 0.21 |
| 19 | 2,2',4,4'-Tetrahydroxy-diphenylsulfide | 2.4 " | 0.70 | 0.17 |
| 20 | 1,1'-Bis(2-hydroxy-3-tert-butyl-5-methylphenyl) methane and | 2.4 " | 0.92 | 0.25 |
| | 2,2',4,4'-Tetrahydroxy-diphenylsulfide | 1.7 " | | |
| 21 | 1,1'-Bis(2-hydroxy-3-tert-butyl-5-methylphenyl) methane and | 2.4 " | 0.95 | 0.23 |
| | β-Naphthol | 1.7 " | | |

EXAMPLE 22 - 28

Image receiving layers were obtained in the same manner as described in Example 15 except that the anti-fogging agents (or whitening agents) listed in the following table were further added to the composition of Example 15. Copying was carried out in the same manner as described in Example 15 and the results shown in the following table were obtained.

Table

| Example | Anti-Fogging Agent (or whitening Agent) | | Optical Density at Image Areas | Optical Density at Non-Image Areas |
|---|---|---|---|---|
| 22 | Tetrachlorophthalic Anhydride | 1.5 parts | 0.65 | 0.05 |
| 23 | 1,3,5-Trinitrobenzene | 1.5 " | 0.70 | 0.10 |
| 24 | Pallaldium Chloride | 1.0 " | 0.58 | 0.06 |
| 25 | Chloroauric Acid | 1.0 " | 0.62 | 0.05 |
| 26 | Silicon Dioxide | 10 " | 0.70 | 0.03 |
| 27 | Zinc Oxide | 10 " | 0.75 | 0.02 |
| 28 | Tetrachlorophthalic Anhydride and | 1.5 " | 0.70 | 0.02 |
| | Zinc Oxide | 10 " | | |

EXAMPLE 29

A light-sensitive layer: The solution having the following composition was coated on a tracing paper in a dry coating amount of 2.3 g/m² and dried.

| | |
|---|---|
| 1-Hydroxy-4-methoxynaphthalene | 0.1 parts |
| Ethylcellulose | 1.5 " |
| Butanone-2 | 60 " |
| Bis[2-(o-chlorophenyl)-4,5-diphenylimidazole] | 1 part |

An image receiving layer: The solution having the following composition was coated on an art paper.

| | | |
|---|---|---|
| $(p\text{-}CH_3CO—C_6H_4COCH_2)_2TeCl$ | 3 | parts |
| Stearylamine-Tellurium Tetrachloride Complex | 2 | " |
| Bisphenol A | 2 | " |
| Vinylidene Chloride-Acrylonitrile Copolymer (molar ratio of acrylonitrile: 35%) | 25 | " |
| Tetrahydrofuran | 250 | " |

The light-sensitive layer was exposed in the same manner as described in Example 1, and contacted with the image receiving layer and then passed through commercially available rollers heated to 130° C (the heating time was about 20 sec.) to obtain a positive copy of a positive original. Image density was 0.55 and fog density was 0.13.

EXAMPLE 30

A light-sensitive layer: The solution having the following composition was coated on a paper of 50 g/m² in a dry coating amount of about 2.0 g/m² and dried.

| | |
|---|---|
| Erythrosine | 0.03 parts |
| 1-Hydroxy-4-methoxynaphthalene | 0.07 " |
| Urea | 0.04 " |
| 1-Phenyl-3-methyl-4-aminopyrozoline-5-one | 0.03 " |
| Ethyl acetate | 180 " |
| Ethyl cellulose | 2.0 " |

Using this light-sensitive layer and the image receiving layer of Example 29, copying was carried out in the same manner as described in Example 29 to obtain an image density of 0.57 and a fog density of 0.15.

EXAMPLE 31

A light-sensitive layer: The solution having the following composition was coated on a polyethylene terephthalate film having a thickness of 100 $\mu$ in a dry coating amount of 2.5 g/m$^2$ and dried.

| | |
|---|---|
| 2-(p-Chlorophenyl)acetoacetonitril | 0.11 parts |
| o-tolylbiguanide | 0.03 parts |
| Dye having the following Structure | 0.05 parts |
| Ethyl cellulose | 2.5 parts |
| Ethyl acetate | 90 parts |
| Methyl alcohol | 5 parts |

Structure of Dye

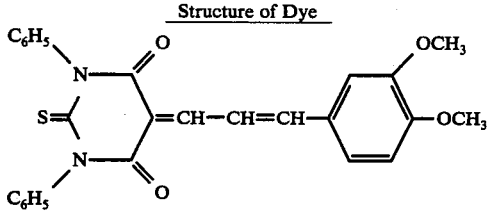

An image receiving layer: The solution having the following composition was coated on a polyethylene terephthalate film (30 $\mu$).

| | |
|---|---|
| p-Acetylaniline-Tellurium Tetrachloride Complex | 4 parts |
| p-t-Octylphenol | 2 " |
| Tetrabromophthalic Anhydride | 1 part |
| Polyvinyl butyral | 25 parts |
| 1,4-Dioxane | 230 " |

Using these layers, copying was carried out in the same manner as described in Example 29 to obtain an image density of 0.62 and a fog density of 0.06.

While the invention has been described in detail and with reference to specific embodiments thereof, it will be apparent to one skilled in the art that various changes and modifications can be made therein without departing from the spirit and scope thereof.

What is claimed is:

1. A method for producing a image comprising image-wise exposing a light-sensitive layer containing an image-forming reducing agent which reducing agent will be transferred to an image-receiving layer upon heating to 80 to 200° C at non-exposed areas and which is changed to a non-transferable compound at exposed areas, contacting said light-sensitive layer with said image-receiving layer containing an organic tellurium compound which can form a color image upon reaction with said image forming reducing agent, and heating said light-sensitive layer to transfer said image-forming reducing agent to said image-receiving layer at non-exposed areas, wherein said image-receiving layer comprises an organic tellurium compound and a binder formed on a support, said organic tellurium compound being reduced to Te during said method by transferred image-forming reducing agent from said non-exposed areas and wherein said organic tellurium compound is one which, when a mixture of the organic tellurium compound and the light-sensitive image-forming reducing agent is heated at 110–150° C, the mixture becomes dark.

2. The method of claim 1, wherein said image-receiving layer further comprises an auxiliary reducing agent different from said image-forming reducing agent.

3. The method of claim 1, wherein said image-receiving layer further comprises an auxiliary reducing agent different from said image-forming reducing agent and an anti-fogging agent.

4. The method of claim 2 wherein said auxiliary reducing agent is selected from compounds where one or more hydrogen atoms of an aromatic ring of an aryl group is substituted for by at least one group or groups represented by $—OR_1$ and/or $—NR_2R_3$, wherein $R_1$ represents a hydrogen atom, an alkyl group or an alkenyl group, a substituted alkyl group or a substituted alkenyl group, wherein $R_2$ and $R_3$ can be the same or different from each other and each represents a hydrogen atom, an alkyl group, an alkenyl group, a substituted alkyl group, a substituted alkenyl group, an aryl group or a substituted aryl group.

5. The method of claim 2 wherein said auxiliary reducing agent comprises a compound where one or more hydrogen atoms of an aromatic ring of an aryl group is substituted for by at least one group or groups represented by $—OR_1$ and/or $—NR_2R_3$, wherein $R_1$ represents a hydrogen atom, an alkyl group or an alkenyl group, a substituted alkyl group or a substituted alkenyl group, wherein $R_2$ and $R_3$ can be the same or different from each other and each represents a hydrogen atom, an alkyl group, an alkenyl group, a substituted alkyl group, a substituted alkenyl group, an aryl group or a substituted aryl group, further wherein one or more hydrogen atom(s) of said aromatic ring of said compound is substituted with at least one of the following substituents: an alkyl group, an alkenyl group, a substituted alkyl group or a substituted alkenyl group.

6. The method of claim 2 wherein said auxiliary reducing agent is selected from one of the following: benzoin, dihydroxyacetate, glyceric aldehyde, 1-naphthohydroxamic acid, kojic acid, N,N-di(2-ethoxyethyl)-hydroxylamine, bis(3-methyl-4-hydroxy-5-tert-butylphenyl)-sulfide, 2,2',4,4'-tetrahydroxydiphenylsulfide, N,N'-bis(m-hydroxyphenyl)urea, 1,3-diphenyl-2-thiourea, ethyleneglycolbis-(m-hydroxyphenyl)-ether, m,m'-dihydroxyoxanilide and methyleneaminoacetonitrile.

7. The method of claim 2 wherein said auxiliary reducing agent comprises an inorganic or organic salt of a reducing metal ion, the metal being capable of exhibiting at least two valence states and in the inorganic or organic salt exhibiting its lowest valence state.

8. The method of claim 1 wherein said image-receiving layer further contains a whitening agent.

9. The method of claim 2 wherein said image receiving layer further contains a whitening agent.

10. The method of claim 3 wherein said image receiving layer further contains a whitening agent.

11. An image-forming assembly comprising a light sensitive layer on one support and an image-receiving layer on a separate support, wherein said light-sensitive layer and said image-receiving layer are in intimate contact so said image-receiving layer is adapted to receive a transferring image from said light-sensitive layer during development following image-wise exposure, said light-sensitive layer containing an image-forming reducing agent which will be transferred to said image-receiving layer upon development by heating to 80° to 200° C in non-exposed areas and which is changed to a non-transferable compound at exposed areas resulting from said image-wise exposure, said image-receiving layer containing an organic tellurium compound and a binder formed on said support, which organic tellurium compound forms a color image upon reaction with said image-forming reducing agent following transfer of said image-forming reducing agent at non-exposed areas, said organic tellurium compound being reduced to Te by said transferred image-forming reducing agent from said non-exposed areas, and wherein said organic tellurium compound is one which, when a mixture of the organic tellurium compound and the light-sensitive image-forming reducing agent is heated at 110°–150° C, the mixture becomes dark.

12. The method of claim 1, wherein said image-forming reducing agent is selected from the group consisting of 4-methoxy-1-naphthol, 1-hydroxy-2-methyl-4-methoxynaphthalene, 1-hydroxy-4-ethoxynaphthalene, 4,4'-dimethoxy-1, 1'-dihydroxy-2,2'-binaphthyl, 1,4-dihydroxy-2,2'-binaphthyl, 1,4-dihydroxynaphthalene or 1,3-dihydroxynaphthalene or a light-sensitive image-forming precursor which is a condensation product of 1,5-dihydroxynaphthalene and acetone or adipolchloride, phenylhydrazone N,N'dimethylhydrazone, 2,5-diphenyloxazole, 2-(1-naphthyl)-5-phenyloxazole or triphenylimidazole.

13. The method of claim 1, wherein said organic tellurium compound is selected from:

compounds selected from general formula (1);

$$Y - TeX_2 - Y' \quad (1)$$

wherein X represents a chlorine, bromine or iodine atom and the two halogen atoms can be the same or different from each other and Y and Y' represent groups selected from the following group (A) to group (C) wherein Y and Y' can be the same or different from each other:

(A) Y and Y' are an Ar — CO — $CH_2$ -group; wherein Ar designates a phenyl group, naphthyl group, anthryl group, furyl group, thienyl group, zanthenyl group, benzofuranyl group, benzoquinonyl group or a substituted group thereof;

(B) Y and Y' are an R — $COCH_2$ — group; wherein R designates an alkyl group; an alkenyl group and a substituted group thereof;

(C) Y, Y' are Ar as defined in (A) or R as defined in (B); compounds represented by general formula (2);

$$Z - TeX_3 \quad (2)$$

wherein X designates a chlorine, bromine or iodine atom, and the three halogen atoms can be the same or different from each other, and Z designates a group belonging to Y, Y' of general formula (1);

complexes formed by tellurium tetrahalide and an organic base, and represented by general formula (3);

$$Dn \cdot TeX_4 \quad (3)$$

wherein X represents a chlorine, bromine or iodine atom and the four halogen atoms can be the same or can be two or three different kinds of halogen atoms, D designates an organic base selected from an aliphatic amine compound, an aralkylamine compound, an aromatic amine compound and a nitrogen atom containing heterocyclic compound, and n designates an interger of 1 to 6.

14. The image-forming assembly of claim 11, wherein said organic tellurium compound is selected from:

compounds selected from general formula (1);

$$Y - TeX_2 - Y' \quad (1)$$

wherein X represents a chlorine, bromine or iodine atom and the two halogen atoms can be the same or different from each other and Y and Y' represent groups selected from the following group (A) to group (C) wherein Y and Y' can be the same or different from each other:

(A) Y and Y' are an Ar — CO — $CH_2$ — group; wherein Ar designates a phenyl group, a naphthyl group, anthryl group, furyl group, thienyl group, xanthenyl group, benzofuranyl group, benzoquinonyl group or a substituted group thereof;

(B) Y and Y' are an R — $COCH_2$ — group; wherein R designates an alkyl group; an alkenyl group and a substituted group thereof;

(C) Y, Y' are Ar as defined in (A) or R as defined in (B);

compounds represented by general formula (2);

$$Z - TeX_3 \quad (2)$$

wherein X designates a chlorine, bromine or iodine atom, and the three halogen atoms can be the same or different from each other, and Z designates a group belonging to Y, Y' of general formula (1);

complexes formed by tellurium tetrahalide and an organic base, and represented by general formula (3);

$$Dn \cdot TeX_4 \quad (3)$$

wherein X represents a chlorine, bromine or iodine atom and the four halogen atoms can be the same or can be two or three different kinds of halogen atoms, D designates an organic base selected from an aliphatic amine compound, an aralkylamine compound, an aromatic amine compound and a nitrogen atom containing heterocyclic compound, and n designates an integer of 1 to 6.

15. The method of claim 1, wherein said light-sensitive layer further contains a sensitizing agent.

16. The image-forming assembly of claim 11, wherein light-sensitive layer further contains a sensitizing agent.

* * * * *